US009196112B2

(12) United States Patent
Heo

(10) Patent No.: US 9,196,112 B2
(45) Date of Patent: Nov. 24, 2015

(54) CLOTHES TREATING APPARATUS WITH METAL CONTROL PANEL

(75) Inventor: Namyeong Heo, Gyeongsangnam-Do (KR)

(73) Assignee: LG ELECTRONICS INC., Seoul (KR)

( * ) Notice: Subject to any disclaimer, the term of this patent is extended or adjusted under 35 U.S.C. 154(b) by 1273 days.

(21) Appl. No.: 13/076,644

(22) Filed: Mar. 31, 2011

(65) Prior Publication Data

US 2011/0241508 A1 Oct. 6, 2011

(30) Foreign Application Priority Data

Apr. 2, 2010 (KR) ..... 10-2010-0030581
Apr. 21, 2010 (KR) ..... 10-2010-0037056

(51) Int. Cl.

| | |
|---|---|
| ***D06F 39/02*** | (2006.01) |
| ***G07F 9/06*** | (2006.01) |
| ***D06F 31/00*** | (2006.01) |
| ***D06F 39/00*** | (2006.01) |
| ***D06F 39/12*** | (2006.01) |
| ***G07F 17/20*** | (2006.01) |

(52) U.S. Cl.

CPC *G07F 9/06* (2013.01); *D06F 31/00* (2013.01); *D06F 39/005* (2013.01); *D06F 39/12* (2013.01); *G07F 17/20* (2013.01); *Y10T 70/554* (2015.04)

(58) Field of Classification Search

CPC ..... G07F 9/06

See application file for complete search history.

(56) References Cited

U.S. PATENT DOCUMENTS 7,410,095 B2 * 8/2008 Selover ..... G07F 9/06 194/350

* cited by examiner

*Primary Examiner* — Michael Barr
*Assistant Examiner* — Jason Riggleman
(74) *Attorney, Agent, or Firm* — Dentons US LLP

(57) ABSTRACT

A clothes treating apparatus with a metal control panel includes a cabinet, a control panel formed of a metal and mounted to one side of a front surface of the cabinet, one or a plurality of installation members mounted at a rear surface of the control panel and disposed within the metal control panel, and at least one of a payment unit, a display unit and a manipulation unit disposed within the control panel, wherein the at least one of the payment unit, the display unit and the manipulation unit is fixed to the installation member.

16 Claims, 7 Drawing Sheets

CLOTHES TREATING APPARATUS WITH METAL CONTROL PANEL

CROSS-REFERENCE TO RELATED APPLICATION

Pursuant to 35 U.S.C. §119(a), this application claims the benefit of earlier filing date and right of priority to Korean Application Nos. 10-2010-0030581, filed on Apr. 2, 2010, and 10-2010-0037056, filed on Apr. 21, 2010, the contents of which is incorporated by reference herein in its entirety.

BACKGROUND OF THE INVENTION

1. Field of the Invention

This specification relates to a clothes treating apparatus with a metal control panel, and more particularly, a clothes treating apparatus with a control panel, in which various manipulation elements are mounted to run the clothes treating apparatus.

2. Discussion of the Related Art

In general, a clothes treating apparatus indicates an apparatus, such as a washing machine for removing contaminants stuck on the laundry, such as clothes or the like, through processes of washing, rinsing, dehydrating and the like, or a drying machine for removing moisture in the laundry after washing by supplying hot air.

Such clothes treating apparatuses are divided into a home use and a commercial use according to their usage purposes. The home clothes treating apparatus is installed at home and used to treat the laundry, while the commercial clothes treating apparatus is installed in a shop or the like to allow unspecified customers to use it with specific charges.

The commercial clothes treating apparatus is installed in a public place for the purpose of the owner's gains to be used by consumers. Accordingly, the commercial clothes treating apparatus should be excellent in safety, maintenance and the like as compared with the home type. That is, the commercial clothes treating apparatus additionally needs a separate washing algorithm capable of maximizing the owner's gains as well as a device for payment and a control algorithm for the device. Also, the commercial clothes treating apparatus should be designed to minimize damages on products or the loss of components caused by customers, and allow a very simple and fast maintenance.

However, the commercial clothes treating apparatus is installed in a specific shop and unspecified customers use it by inserting charges. Furthermore, most of shops are run by an unmanned system, and there may be much concern about coins inserted in a coin box being stolen.

In general, the coin box for the commercial clothes treating apparatus is installed in an upper portion of the apparatus, namely, near a rear surface of a control panel, which is fabricated by injecting plastic in a mold. Consequently, the coin box installed in the clothes treating apparatus may be in danger of being taken by breaking the plastic control panel of the clothes treating apparatus.

In addition, the commercial clothes treating apparatus requires a longer operation time than the typical home clothes treating apparatus and is used by many users. Thus, the commercial clothes treating apparatus should have a high level of durability. However, the plastic control panel is vulnerable in view of the durability.

SUMMARY OF THE INVENTION

Therefore, to overcome the drawbacks of the related art, an aspect of this detailed description is to provide a clothes treating apparatus having a control panel with higher rigidity than the related art.

To achieve these and other advantages and in accordance with the purpose of this specification, as embodied and broadly described herein, a clothes treating apparatus with a metal control panel may include a cabinet, a control panel formed of a metal and mounted to one side of a front surface of the cabinet, one or a plurality of installation members mounted at a rear surface of the control panel and disposed within the metal control panel, and at least one of a payment unit, a display unit and a manipulation unit disposed within the control panel, wherein the at least one of the payment unit, the display unit and the manipulation unit is fixed to the installation member.

In the aspect, the control panel may be made of a metal other than synthetic resin as in the related art, thus to improve rigidity thereof, and accordingly enhance security of the apparatus. Here, various components, such as a payment unit like a coin box or a card reader, a display unit for displaying working state of the apparatus, a manipulation unit for manipulation of the apparatus and the like, which are required to run the clothes treating apparatus, are mounted at a rear surface of the control panel. In the related art, bosses are formed at the rear surface of the control panel and fixing elements such as screws are coupled to the bosses to fix those components.

Here, in order to form the bosses on the control panel made of a metal, such as steel, a machining such as a pressing process is required. However, there may be a limitation on the height of the boss capable of being formed through the machining with maintaining rigidity of the material. Furthermore, a thin steel should be used to reduce weight and a material cost, but the use of the thin steel may rather cause lowering of the rigidity of the control panel, which may deteriorate the portion formed through the machining. Therefore, in the aspect, the control panel may be formed of a metal, and an installation member may separately be employed for mounting of the components to provide a space to allow coupling of the fixing members such as screws. Consequently, the control panel can be fabricated by use of a steel sheet with an appropriate thickness and simultaneously various components can be stably mounted to the control panel.

Here, the installation member may be formed of synthetic resin and have a random form. For example, the installation member may be in the form of a plate.

Also, the installation member may include bosses for coupling the at least one of the payment unit, the display unit and the manipulation unit.

Here, the coupling members corresponding to the bosses may be provided at the at least one of the payment unit, the display unit and the manipulation unit.

Also, coupling elements may further be provided for simultaneous coupling of the coupling members, the installation member and the control panel. Here, the coupling element may include a screw inserted through the coupling member and the installation member to be fixed to the control panel. That is, one screw may be simultaneously fixed to the coupling member, the installation member and the control panel, thereby simplifying an assembly operation.

Meanwhile, at least one opening may be formed at the installation member and the control panel, respectively. A part of the installation member may be exposed out of the cabinet via the opening. The opening of the installation member may be formed to externally expose the payment unit, the display unit, the manipulation unit and the like, installed at the installation member, out of the control panel. Also, synthetic resin may be relatively easier to print or carve characters or figures than a steel plate, accordingly, the exposed portion of the installation member via the control panel may be used as a space, in which various information related to operations of the clothes treating apparatus are recorded (stored).

The information, for example, may include a meaning of an item displayed via the display unit, a function of the manipulation unit and the like.

A panel frame, which is coupled to the cabinet, may be mounted at an upper side of the front surface of the cabinet. Here, the payment unit may further include a coin box having a front surface externally exposed out of the control panel, and the coin box may be fixed to the panel frame. The coin box is relatively heavy, so it can be stably supported by being fixed to the panel frame.

In accordance with another aspect of the detailed description, there is provided a clothes treating apparatus including a top plate defining an upper side of a cabinet, a panel frame coupled to the cabinet at an upper side of a front surface of the cabinet, a control panel coupled to a front surface of the panel frame and having manipulation buttons, a coin box inserted in one side of the control panel to store coins inserted therein, and a coin box protection member covering the coin box for protection, and coupled to the panel frame, wherein the panel frame, the control panel and the coin box protection member may be made of steel.

The apparatus may further include a first locking member configured to lock or unlock the control panel at or from the panel frame. The first locking member may be run by a first security key. The first locking member may include a first key recess for insertion of the first security key therein. The first locking member may be inserted in the first key recess and turned right or left to lock or unlock the control panel at or from the panel frame.

The apparatus may further include a second locking member configured to lock or unlock the top plate at or from the panel frame. The second locking member may be run by a second security key. The second locking member may include a second key recess for insertion of the second security key therein. The second locking member may be inserted in the second key recess and turned right or left to lock or unlock the top plate at or from the panel frame.

The coin box protection member may have a shape of a rectangular box, and the coin box may be inserted therein to be drawn out. An outer surface of the coin box protection member may be welded onto the panel frame.

In accordance with another aspect of the detailed description, there is provided a clothes treating apparatus including a lower apparatus having a coin box for keeping coins and an upper apparatus disposed above the lower apparatus and having a coin insertion hole, in which coins stored in the coin box are inserted, wherein a coin box protection member covering the coin box is welded onto a cabinet of the lower apparatus.

The apparatus may further include a first locking member configured to lock or unlock a control panel at or from the cabinet, the control panel being located at an upper side of a front surface of the lower apparatus, and the first locking member may be run in response to a first security key being inserted and turned. Also, the apparatus may further include a second locking member configured to lock or unlock a top plate at or from the cabinet, and the second locking member may be run in response to a second security key being inserted and turned.

Also, in another aspect of the detailed description, there is provided a clothes treating apparatus for treating clothes in response to coins being inserted therein, wherein a security key is needed to detach a control panel and a top plate of the clothes treating apparatus.

The apparatus may further include a coin box for keeping coins inserted therein and a coin box protection member for covering the coin box for protection, and the coin box protection member may be welded onto a cabinet or a panel frame.

In accordance with the aspects, the control panel may be made of a metal, and components required for operations of the clothes treating apparatus may be mounted at the installation member disposed at the rear surface of the control panel, thereby remarkably improving rigidity and durability of the control panel as compared to the related art.

In addition, to detach the coin box without a coin box security key for drawing the coin box out, the control panel and the top plate should first be detached, and for this, a separate security key is further needed. Therefore, the possibility that the clothes treating apparatus is stolen by a third party can be remarkably decreased, thereby improving user's reliability and satisfaction.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE ILLUSTRATED EMBODIMENTS

Hereinafter, description will be given in detail of the exemplary embodiments of a clothes treating apparatus with reference to the accompanying drawings.

Figure 1:
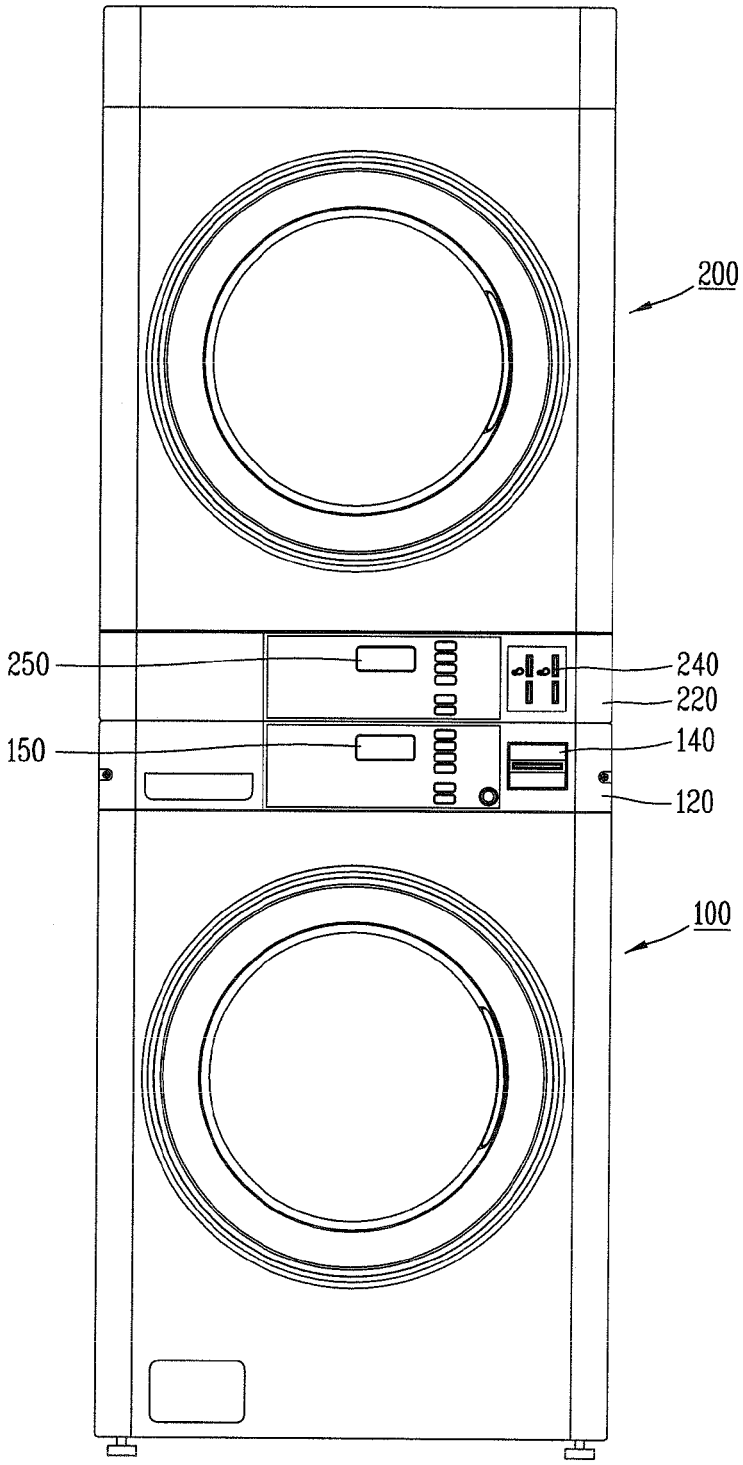
FIG. 1 is a front view showing one exemplary embodiment of a clothes treating apparatus having a control panel.
Figure 2:
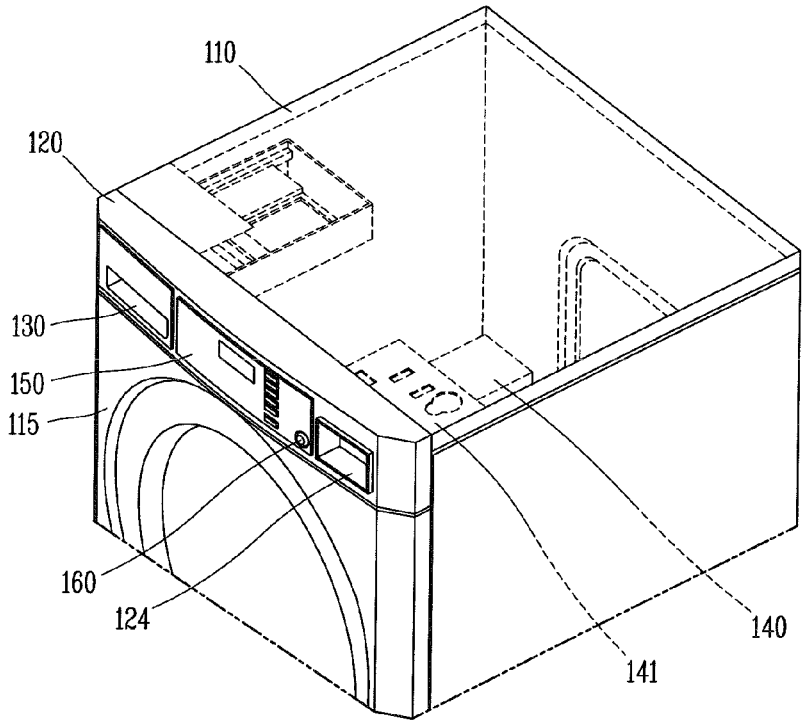
FIG. 2 is a perspective view showing a lower clothes treating apparatus of the one exemplary embodiment shown in FIG. 1.
Figure 3:
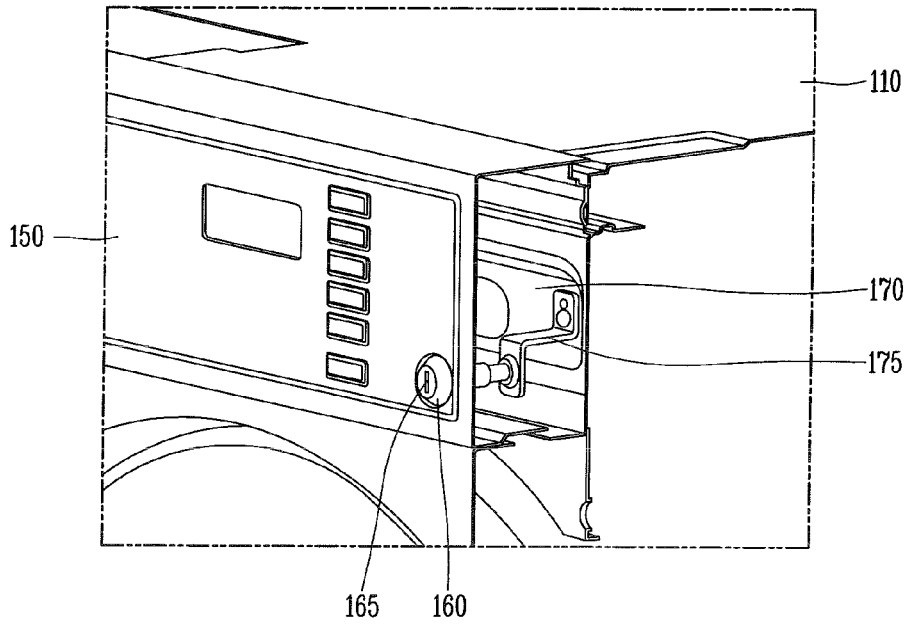
FIG. 3 is a partially cut view showing a portion of the control panel of FIG. 2.
Figure 4:
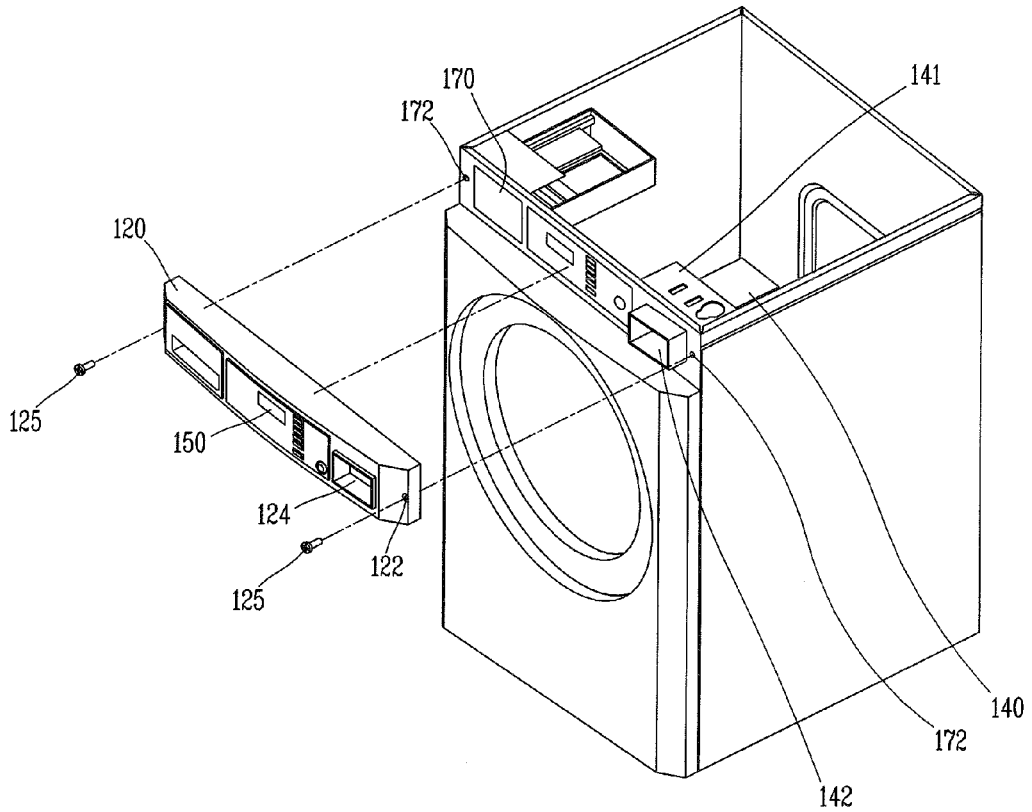
FIG. 4 is a disassembled perspective view showing a mounting structure of the control panel of FIG. 1.

FIG. 1 is a front view showing one exemplary embodiment of a clothes treating apparatus having a control panel, FIG. 2 is a perspective view showing a lower clothes treating apparatus of the one exemplary embodiment shown in FIG. 1, FIG. 3 is a partially cut view showing the control panel of FIG. 2, and FIG. 4 is a disassembled perspective view showing a mounting structure of the control panel of FIG. 1

Commercial clothes treating apparatuses are arranged in plurality side by side, or above and below, and users use such clothes treating apparatuses by inserting charges. The exemplary embodiment shown in FIG. 1 is a type that the clothes treating apparatuses are arranged above and below. For the sake of explanation, a lower clothes treating apparatus is referred to as a first clothes treating apparatus 100 and an upper clothes treating apparatus is referred to as a second clothes treating apparatus 200. Each of the first and second clothes treating apparatuses 100 and 200 may be a washing machine or a drying machine. Hereinafter, for the sake of explanation, description will be given of a case that the first clothes treating apparatus 100 is a washing machine and the second clothes treating apparatus 200 is a drying machine.

Referring to FIGS. 1 to 4, the first clothes treating apparatus 100 may include a tub disposed within a main body defining an outer appearance for storing washing water therein, a drum for performing a washing stroke with rotating in the tub, a spring and a damper for buffering the tub, and the like. The second clothes treating apparatus 200 may include a rotating drum installed in the main body to allow the laundry stored therein to be dried, a heater for heating air supplied into the rotating drum, a duct for guiding the heated hot air, and the like. The inner structure required to run the washing machine and the drying machine is similar to that of the related art, so detailed description thereof will be omitted.

The clothes treating apparatus 100 may include a top plate 110 defining an upper surface and a front plate 115 defining a front surface, and a control panel 120 located at an upper side of the front surface to display a working state of the washing machine and control operations of the washing machine. The control panel 120 may include various manipulation buttons as a manipulation element for inputting operation commands of the washing machine, a detergent box 130, a coin box 140 for keeping coins inserted for use of the washing machine, and the like. Also, a display unit 150 as a display element for displaying an operational state of the clothes treating apparatus may be installed approximately at the central portion of the control panel 120.

A control panel 220 may also be installed at a lower side of the front surface of the second clothes treating apparatus 200. The control panel 200 may include a coil insertion hole 240, through which coins are inserted to use the clothes treating apparatus. The control panel 220 of the second clothes treating apparatus 200 may also include manipulation buttons and a display unit 250.

The commercial clothes treating apparatus runs in response to charges input by a user. For this, coins inserted into the coin insertion hole 240 of the second clothes treating apparatus 200 is stored within the coin box 140 of the first clothes treating apparatus 100. When the user selects a desired washing course and time, the clothes treating apparatus runs after a proper charge is paid in correspondence with the selected washing course and time.

A coin box key recess (not shown) may be formed at a front surface of the coin box 140 of the first clothes treating apparatus 100. A lessor of the commercial clothes treating apparatus may insert a security key for the coin box 140 in the coin box key recess and turn the key to release the locked state of the coin box 140. Then, the lessor may draw the coin box 140 out with grasping a handle part. Accordingly, the lessor may gather coins stored in the coin box 140. Therefore, the coin box security key should be given for drawing the coin box 140 out.

However, the commercial clothes treating apparatus is installed in a specific place and thus customers inserts charges for use thereof. Also, most of shops are run by unmanned systems. As a result, a problem that the coin box is taken off and coins therein are stolen has occurred. That is, to take the coin box off the clothes treating apparatus, the control panel 120 and the top plate 110 disposed at the upper side of the front surface of the clothes treating apparatus have been destroyed.

Concerning about such problem, the control panel 120, 220 and the top plate in the exemplary embodiment may be made of steel sheet so as to improve their rigidities as compared with the related art, thereby preventing them from being easily destroyed. Also, such structure may also be psychologically felt as a strong image, thereby lowering the will to steal. Alternatively, one of the control panel and the top plate may be made of synthetic resin.

In the meantime, bolt insertion portions 122, in which fixing bolts 125 are inserted and fixed, may be formed near both ends of the control panel 120 (the upper control panel 220 of the second clothes treating apparatus 200 also has the same structure, so it will not be described again) by being recessed into the surface of the control panel 120. A panel frame 170 may be disposed at an upper portion of the front panel 115 at a position retreated inwardly by a thickness of the control panel 120.

Coupling holes 172, in which the fixing bolts 125 are inserted, may be formed at both side surfaces of the panel frame 170 such that the control panel 120 can be stably fixed thereto. Here, the fixing bolt 125 may be designed to have a head with a specific shape other than a typical cross recess bolt or a slotted bolt, thereby making it difficult to separate it without an exclusive tool therefor.

The panel frame 170 may serve as a base for securing the control panel, as described above. The panel frame 170 may also function as blocking an access into the main body even when the control panel is detached.

The panel frame 170 may be made of steel. The panel frame 170 may be a part of the frame configuring the first clothes treating apparatus 100, and serve as a support member, to which the control panel is attached and secured. The coupling between the control panel 120 and the panel frame 170 may be implemented by a hook coupling, a bolt coupling or the like.

In the exemplary embodiment, an additional locking member may be provided, in addition to the fixing bolts 125, between the control panel 120 and the panel frame 170. That is, a first locking member 160 may be located between the control panel 120 and the panel frame 170. Accordingly, in order to separate the control panel 120 from the panel frame 170, the first locking member 160 should first be detached. The first locking member 160 may be run by a first security key (not shown), and include a first key recess 165 for insertion of the first security key therein. When the first security key is inserted in the first key recess of the first locking member 160 to be turned right or left, the control panel 120 may be locked at the panel frame 170 to be in an inseparable state or unlocked to be in a separable state from the panel frame 170.

The first locking member 160 may have a locking structure of being inserted in a recess formed into the control panel 120 such that the inserted end thereof can be coupled to the panel frame 170. Here, the end of the first locking member 160 may be inserted in the recess formed at the panel frame 170, or a fixing member 175, in which the end of the first locking member 160 is inserted and secured, may separately be formed at the panel frame 170, as shown in FIG. 3.

Figure 5:
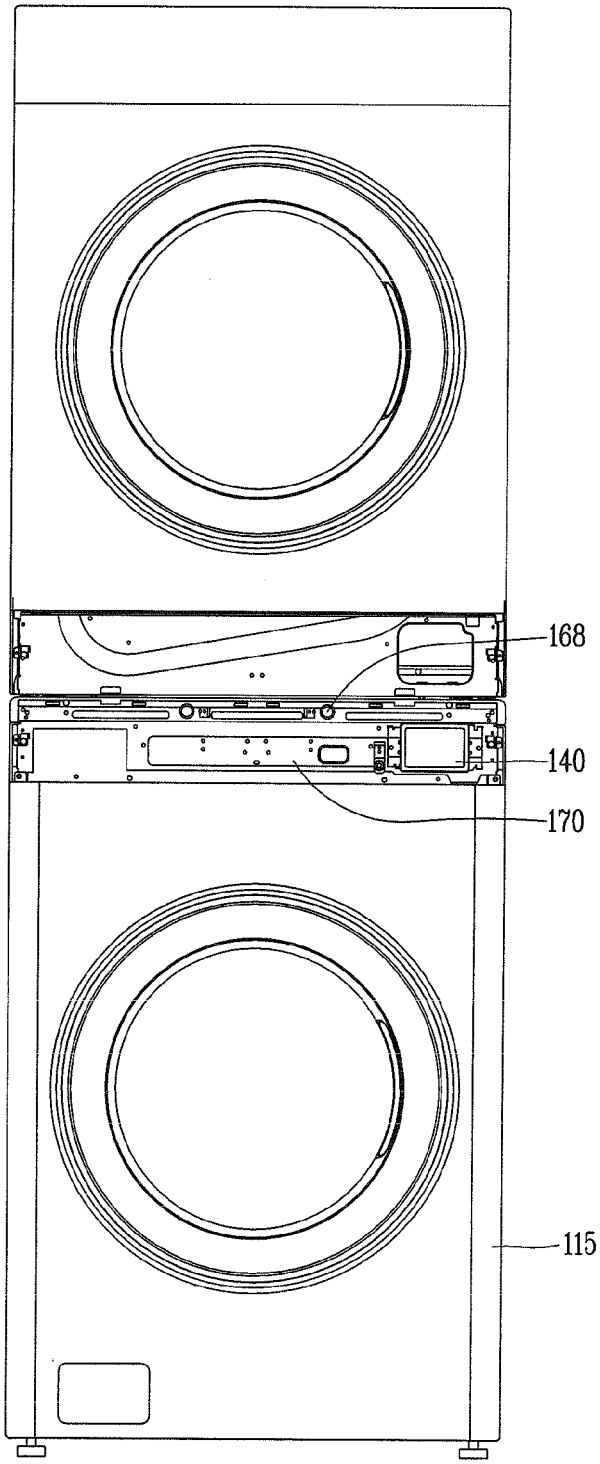
FIG. 5 is a disassembled perspective view showing a mounting structure of the control panel and a display unit of FIG. 1.
Figure 6:
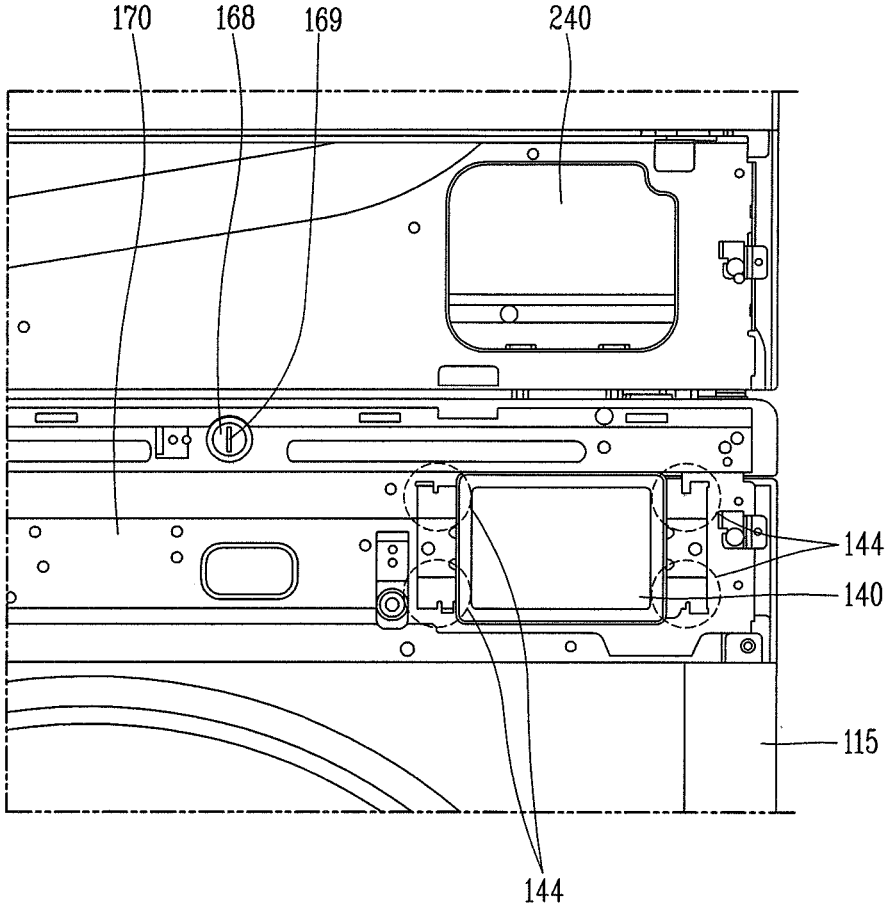
FIG. 6 is a front view showing a state of the control panel being removed from FIG. 1.

FIG. 5 shows an internal shape of the clothes treating apparatus of FIG. 1, from which the control panel is detached. As shown in FIG. 5, in order to enhance security, the clothes treating apparatus may further include a second locking member 168 for locking or unlocking the top plate 110 to or from the panel frame 170.

The second locking member 168 may operate similar to the first locking member 160 described above. That is, the second locking member 168 may be run by a second security key (not shown), and include a second key recess 169, in which the second security key (not shown) is inserted. When the second security key is inserted in the second key recess to be turned right or left, the top plate 110 may be locked at the panel frame 170 to be in an inseparable state, or unlocked therefrom to be in a separable state. The second locking member 168 may have a locking structure of being inserted in a recess formed into the panel frame 170 such that the inserted end thereof may be coupled to the top plate 110.

The coin box 140 may be fixed to the panel frame 170. In detail, a guide 142 having an approximately rectangular shape may be installed at a front side of the coin box 140, such that a coin locker 146 within the coin box 140 can be externally drawn out via the guide 142. Therefore, the guide 142 of the coin box 140 may be externally exposed via a coin box draw-out hole 124 of the control panel 120, and the remaining portion excluding the guide 142 may be located at the rear side of the panel frame 170. A fixing structure of the coin box 140 will be described later.

The control panel 120 may include a printed circuit board (PCB) 10 having electronic circuits necessary to operate the display unit and the manipulation buttons described above. The PCB 10 may be installed at a rear surface of the control panel 120, with being spaced apart from the rear surface of the control panel 120 to absorb impacts transferred from the front surface of the control panel 120 and improve insulating properties.

Figure 7:
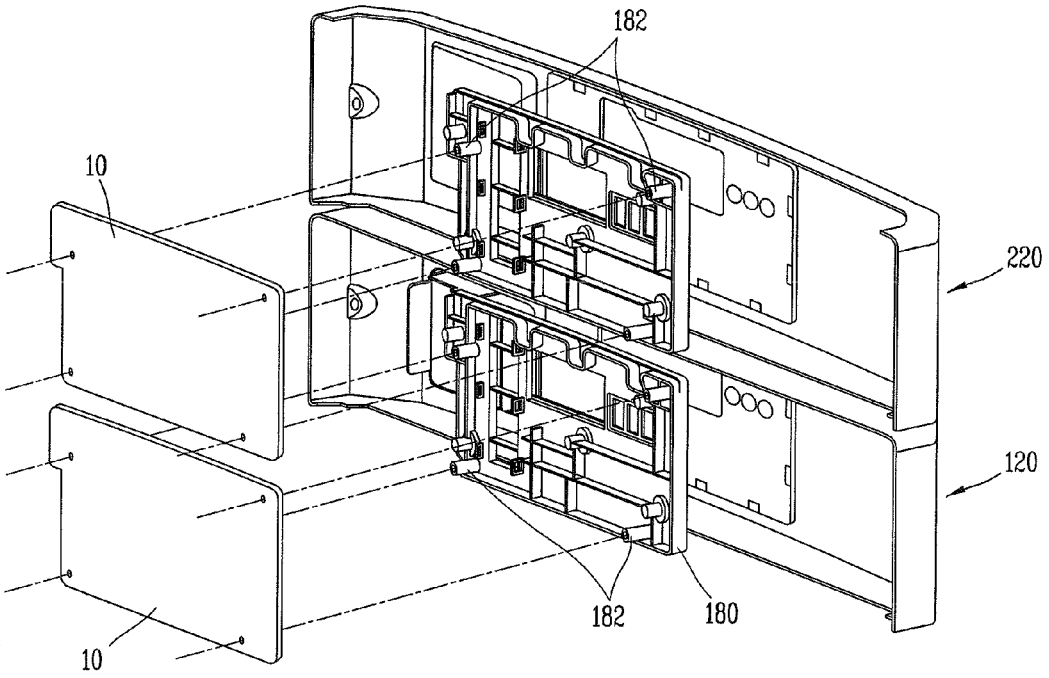
FIG. 7 is a front view showing a partially enlarged portion of FIG. 6.

Therefore, as shown in FIG. 7, an installation plate 180 as an installation member made of synthetic resin may further be provided at the rear surface of the control panel 120. The installation plate 180 may include bosses 182 for installing the PCB 10 having the display unit. The bosses 182 may protrude from the surface of the installation plate 180 by a predetermined distance (length), which allows the PCB 10 to be spaced apart from the control panel 120 by the predetermined distance.

Of course, the bosses 182 may be formed directly on the control panel 120. However, if the bosses 182 protruding as long as shown in the drawing are formed of thin steel sheet through a pressing process, the steel sheet may be in danger of being torn or being weak in rigidity. Thus, if the separate installation plate 180 is used as shown in the embodiment, the formation of the control panel 120 can be facilitated even if thin steel sheet is used.

The PCB 10 may be installed at the installation plate 180 by separate fixing screws or the like and the installation plate 180 may be fixed to the control panel 120 by separate members; however, this specification may not be limited to this structure. Alternatively, the installation plate 180 and the PCB 10 may simultaneously be fixed to the control panel 120 by the fixing screws.

Figure 8:
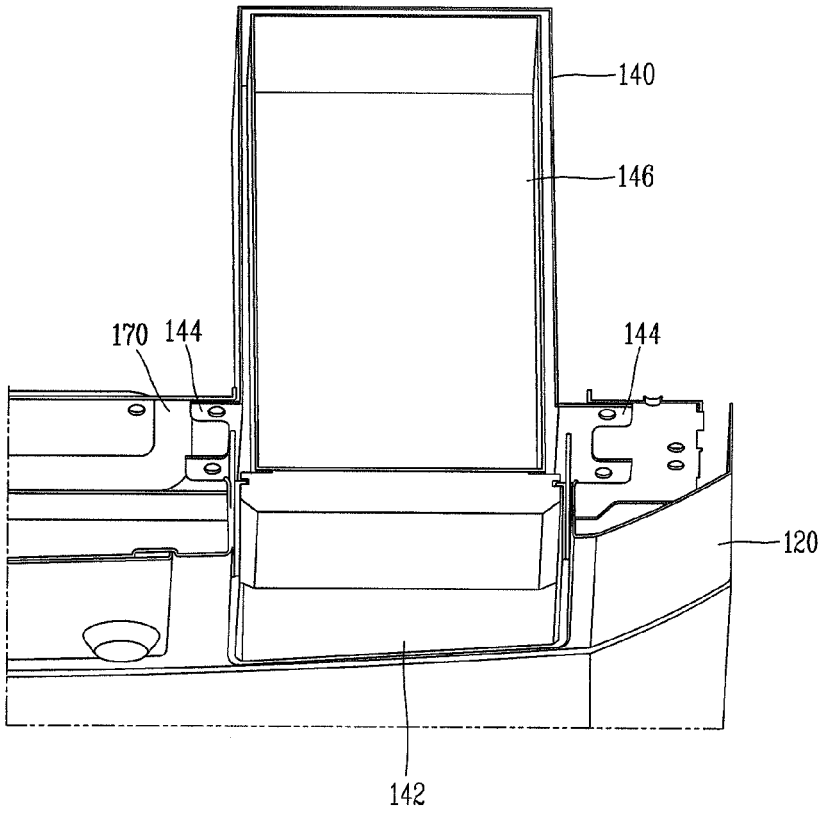
FIG. 8 is an enlarged perspective view of a coupling structure of a coin box shown in FIG. 1.

FIG. 8 is a perspective view showing an installation structure of the coin box 140.

As shown in FIG. 8, four screw coupling portions 144 may protrude from both side surfaces of the coin box 140 by two each. The screw coupling portions 144 may then be fixed to the panel frame 170 using screws, thereby installing the coin box 140. Alternatively, the screw coupling portions 144 may be fixed to the panel frame 170 through welding other than use of the screws.

Here, the guide 142 may be disposed to be exposed outside the control panel 120, and the coin locker 146 may be slidably installed within the coin box 140 to be drawn out of the guide 142.

A coin box protection member 141 for covering an outer circumferential portion of the coin box 140 may further be provided. The coin box protection member 141 may be formed of steel in an approximately square box, and the coin box 140 may be inserted therein to be drawn out.

An outer surface of the coin box protection member 141 may be welded onto the panel frame 170. The welding may be carried out at a partial portion of the outer surface of the coin box protection member 141, or at an overall outer surface thereof. The embodiment exemplarily shows that the welding is carried out at four portions of the outer circumferential portion. As such, the coin box 140 may be firmly installed within the steel protection member 141 welded onto the panel frame 170, which makes it difficult to take the coin box 140 off after disassembling the clothes treating apparatus, thereby allowing reduction of risks of robbery.

Figure 9:
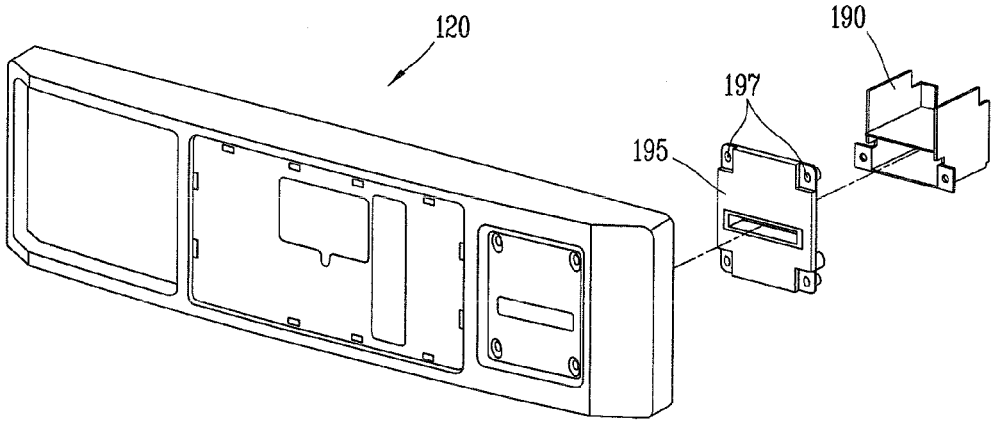
FIG. 9 is a disassembled perspective view showing a mounting structure of a control panel and a card reader in accordance with another exemplary embodiment.

In the meantime, various devices other than the coin box 140 may be applied to the exemplary embodiments. For example, an example of employing a card reader as a payment element may be conceivable. Even in this example, as shown in FIG. 9, a reader installation plate 195 may be disposed between the rear surface of the control panel 120 and a card reader 190, and the card reader 190 may be coupled to bosses 197 formed at the installation plate 195.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A clothes treating apparatus, comprising:

a cabinet having a top plate;

a panel frame coupled to the cabinet at an upper side of a front surface of the cabinet;

a control panel coupled to a front surface of the panel frame and having manipulation buttons;

a coin box inserted at one side of the control panel to store coins inserted therein; and a coin box protection member covering the coin box for protection, and coupled to the panel frame, wherein the panel frame, the control panel, and the coin box protection member are made of metal.

2. The apparatus of claim 1, further comprising:

a first locking member to lock or unlock the control panel at or from the panel frame, wherein the first locking member is locked or unlocked by a first security key.

3. The apparatus of claim 2, wherein the first locking member comprises a first key recess for insertion of the first security key therein, and wherein the first locking member is inserted in the first key recess and turned right or left to lock or unlock the control panel at or from the panel frame.

4. The apparatus of claim 3, further comprising:

a second locking member to lock or unlock the top plate at or from the panel frame, wherein the second locking member is locked or unlocked by a second security key.

5. The apparatus of claim 4, wherein the second locking member comprises a second key recess for insertion of the second security key therein, and wherein the second locking member is inserted in the second key recess and turned right or left to lock or unlock the top plate at or from the panel frame.

6. The apparatus of claim 1, wherein the coin box protection member has a rectangular box shape, and the coin box is inserted therein to be drawn out.

7. The apparatus of claim 6, wherein an outer surface of the coin box protection member is welded onto the panel frame.

8. The apparatus of claim 1, further comprising:

at least one installation member mounted at a rear surface of the metal control panel and disposed within the metal control panel; and at least one of a payment unit, a display unit, and a manipulation unit disposed within the metal control panel, wherein the at least one of the payment unit, the display unit, and the manipulation unit is fixed to the at least one installation member.

9. The apparatus of claim 8, wherein the at least one installation member is made of a synthetic resin.

10. The apparatus of claim 8, wherein the at least one installation member comprises:

a plurality of bosses to couple the at least one of the payment unit, the display unit, and the manipulation unit to the at least one installation member.

11. The apparatus of claim 10, wherein coupling members corresponding to the plurality of bosses are disposed at the at least one of the payment unit, the display unit, and the manipulation unit.

12. The apparatus of claim 11, further comprising:

a plurality of coupling elements for simultaneously coupling the coupling members, the installation member, and the control panel.

13. The apparatus of claim 12, wherein at least one of the plurality of coupling elements comprises:

a screw inserted through the coupling member and the installation member to be fixed to the control panel.

14. The apparatus of claim 1, further comprising:

a lower apparatus having the coin box for keeping coins; and an upper apparatus, disposed above the lower apparatus, having a coin insertion hole, in which coins stored in the coin box are inserted, wherein the coin box protection member covers the coin box and welded onto a cabinet of the lower apparatus.

15. The apparatus of claim 14, further comprising:

a first locking member to lock or unlock the control panel at or from the cabinet, the control panel being located at an upper side of a front surface of the lower apparatus, wherein the first locking member is locked or unlocked in response to a first security key being inserted and turned.

16. The apparatus of claim 15, further comprising:

a second locking member to lock or unlock a top plate at or from the cabinet, wherein the second locking member is locked or unlocked in response to a second security key being inserted and turned.

* * * * *